US007854040B1

(12) United States Patent
Ramos

(10) Patent No.: US 7,854,040 B1
(45) Date of Patent: Dec. 21, 2010

(54) PORTABLE GERM BARRIER

(76) Inventor: Ferdinand Ramos, 29099 W. Madrid Pl., Santa Clarita, CA (US) 91384

( * ) Notice: Subject to any disclaimer, the term of this patent is extended or adjusted under 35 U.S.C. 154(b) by 275 days.

(21) Appl. No.: 12/241,336

(22) Filed: Sep. 30, 2008

Related U.S. Application Data

(60) Provisional application No. 60/976,712, filed on Oct. 1, 2007.

(51) Int. Cl.
*A47B 95/02* (2006.01)

(52) U.S. Cl. ..... 16/110.1; 16/435; 16/904; 135/98

(58) Field of Classification Search ..... 16/904, 16/110.1, 412–414, 431, 422, 426, 435; 135/98, 135/22–24; 206/38
See application file for complete search history.

(56) References Cited

U.S. PATENT DOCUMENTS

| | | | | | |
|---|---|---|---|---|---|
| 1,414,616 | A * | 5/1922 | Beehler | 135/90 |
| 2,227,554 | A * | 1/1941 | Riordon | 135/19.5 |
| 2,771,087 | A * | 11/1956 | Simonson | 135/126 |
| 4,148,102 | A * | 4/1979 | Ying-Yu | 2/171.03 |
| 4,449,542 | A * | 5/1984 | McSwain et al. | 135/98 |
| 4,856,140 | A | 8/1989 | Visco et al. | |
| 4,966,178 | A * | 10/1990 | Eichhorn | 135/123 |
| 5,117,851 | A * | 6/1992 | Chang | 135/98 |
| 6,353,971 | B1 * | 3/2002 | Krawczyk | 16/412 |
| 6,401,739 | B1 * | 6/2002 | Bright et al. | 135/98 |
| 6,546,594 | B1 | 4/2003 | Wills | |
| 6,560,335 | B2 * | 5/2003 | Zohn et al. | 379/452 |
| 6,912,728 | B2 | 7/2005 | Panella | |
| H2137 | H | 1/2006 | Newman et al. | |
| 2006/0010652 | A1 * | 1/2006 | Kellaher et al. | 16/413 |
| 2006/0200891 | A1 | 9/2006 | Geraci | |

* cited by examiner

*Primary Examiner*—William L. Miller
(74) *Attorney, Agent, or Firm*—QuickPatents, Inc.; Kevin Prince

(57) ABSTRACT

A portable, compact germ barrier for protecting a person from direct contact with an unsanitary surface, such as a doorknob, a toilet handle, or the like, is disclosed. A flexible fabric web is fixed to a plurality of stiffening rods that are each pivotally connected at a proximal end thereof to an actuating mechanism fixed through a central aperture of the web. The actuating mechanism includes an actuator for moving the ribs between a closed and an open position. In use, the person manually actuates the actuator, causing the actuating mechanism to pivot each of the ribs from the closed position into the open position. When in the open position, the germ barrier may be used to grasp the surface through the web, preventing direct contact between the person and the surface. The germ barrier is portable, compact, easy to use and it may be kept close-by, such as on a keychain.

9 Claims, 6 Drawing Sheets

PORTABLE GERM BARRIER

CROSS-REFERENCE TO RELATED APPLICATIONS

This application is a non-provisional application of U.S. Provisional Application 60/976,712, filed on Oct. 1, 2007, and incorporated herein by reference.

STATEMENT REGARDING FEDERALLY SPONSORED RESEARCH AND DEVELOPMENT

Not Applicable.

FIELD OF THE INVENTION

This invention relates to sanitary barriers, and more particularly to a portable, collapsible sanitary barrier.

DISCUSSION OF RELATED ART

Doorknobs, toilet handles, faucet knobs, and the like that are used by a multitude of people, such as in public restrooms, are well known to carry various harmful microbial agents. While it is advisable to wash one's hands after contacting such surfaces, it is not always practical or easy to remember to do so. Thus after contacting such an unsanitized surface, a person's hands may become contaminated with the harmful agent. Once carried by a person's hands, the harmful agent has a much greater chance of infecting the person through the person's incidental contact with his eyes, mouth, food, and the like.

Numerous innovations for sanitary covers have been provided in the prior art that will be described. Even though these innovations may be suitable for the specific individual purposes to which they address, however, they differ from the present invention.

A first example, U.S. Pat. No. 4,856,140, Issued on Aug. 15, 1989, to Visco et al. teaches a cover for a knob or handle that carries a disinfectant in its porous material adapted to be slidably engaged over the knob or handle in order to substantially act as a barrier between the fingers of a person and the possible contaminated surface of the knob or handle. The cover includes a cup-like portion defining a pocket for insertably receiving the knob or handle in close frictional engagement. A neck portion extends or projects from the pocket to cover the mounting shaft of the knob or handle, and, if desired, a band retainer may be employed for holding the cover in place. A plurality of slits or openings are provided through the material, permitting the user's fingers to grab limited surface areas of the knob or handle allowing knob turning.

In this prior art patent the cover must be placed directly over the knob or handle in a stationary manner. In the present invention the germ barrier will temporarily engage with the knob or handle to protect a person from receiving germs therefrom.

A second example, U.S. Pat. No. 6,546,594, Issued on Apr. 15, 2003, to Wills teaches a covering device for use with a door handle and interconnecting shaft extending from a hingedly secured door. The device includes an elasticized body having a substantially three dimensional shape with an inner face, an outer face, and an open inserting end defined around a narrowed neck of the body. The body further including a flexible and plasticized material which may be covered by a soft fabric outer layer. A resilient retaining portion, such as an elasticized ring is disposed around the neck in association with the open inserting end and for securing the body in place over the door handle and shaft. Frictional engagement is provided between the inner face of the elasticized body and the door handle surface in use and is preferably provided as an adhesive tacking surface which may be incorporated into an inner ply of the covering device or spray applied. A portable and carryable dispenser holds, in compressed fashion, a plurality of individual and elasticized bodies which provides for the selective dispensing of individual ones of the bodies.

In this prior art patent the covering device must be placed directly over the door handle and interconnecting shaft in a stationary manner. In the present invention the germ barrier will temporarily engage with the door handle to protect a person from receiving germs therefrom.

A third example, U.S. Pat. No. 6,912,728, Issued on Jul. 5, 2005, to Panella teaches an apparatus and method for using a hygienic device to form a barrier between an object to be grasped, such as a doorknob, and a user's palm and fingers to prevent the transfer of unwanted bacteria and germs. The device is a covering for the palm and fingers of the user's hand which creates a barrier between the doorknob and the user's palm and fingers to prevent the transfer of germs thereto. The device is envisioned to have a pocket or other means to facilitate positioning of the hygienic device on the user's hand, with the pocket being of size to receive one or more fingers up to a depth of less than the middle knuckle. The method for using the hygienic device further includes providing a dispenser for holding multiple hygienic devices, a single device can be removed from the holder which is then placed upon the user's hand and is then used. After the hygienic device is used it can be disposed of as needed by the user.

In this prior art patent the hygienic device must be worn on the fingers of a user when grasping the doorknob. In the present invention the germ barrier is carried on a keychain and deployed by a person to make contact with the doorknob.

A fourth example, U.S. Statutory Invention Registration No. H2137, Published on Jan. 3, 2006, to Newman et al. teaches an insulated elastic cover that slips snuggly over an interior or exterior doorknob. It is constructed in a manner that allows locking and unlocking actions, as well as the ability to turn the doorknob. Invention takes advantage of state-of-the-art materials to maximize insulating properties while minimizing bulk. Additionally, material is impregnated with anti-bacteriological medium that destroys hand-borne bacteria transferred from hand to doorknob.

In this prior art patent the insulated elastic cover must be placed directly over the interior or exterior doorknob in a stationary manner. In the present invention the germ barrier will temporarily engage with the interior or exterior doorknob to protect a person from receiving germs therefrom.

A fifth example, U.S. Patent Office Document No. 2006/0200891, Published on Mar. 14, 2006, to Geraci teaches an appropriately-sized protective hand cover for children that is made of a suitable barrier material and is used for reducing the potential adverse health impacts associated with dermal and ingestion exposures to infectious disease pathogens and environmental contaminants that are often found in areas where children frequent, such as public bathrooms, and during certain activities, such as painting and baking. The device is preferably mitten-shaped and includes a fastening device adapted to securely fasten the device around at least a portion of the child's hand.

In this prior art application the protective hand cover must be worn on a hand of a child. In the present invention the germ barrier is carried on a keychain and deployed by a person to make contact with unsanitary surfaces.

It is apparent now that numerous innovations for sanitary covers have been provided the prior art that are adequate for various purposes. Furthermore, even though these innovations may be suitable for the specific individual purposes in which they address, accordingly, they would not be suitable for the purposes of the present invention as heretofore described.

Therefore, there is a need for a germ barrier device that is compact, easy-to-use, and effective. Such a needed device would be easy to transport and kept close-by, such as on a keychain. The present invention accomplishes these objectives.

SUMMARY OF THE INVENTION

AN OBJECT of the present invention is to provide a germ barrier that avoids the disadvantages of the prior art.

ANOTHER OBJECT of the present invention is to provide a germ barrier that is simple and inexpensive to manufacture.

STILL ANOTHER OBJECT of the present invention is to provide a germ barrier that is a portable, compact, and easy to use.

BRIEFLY STATED, STILL YET ANOTHER OBJECT of the present invention is to provide a germ barrier for protecting a person from direct contact with an unsanitary surface, such as a doorknob, a toilet handle, or the like. A flexible fabric web is fixed to a plurality of stiffening rods that are each pivotally connected at a proximal end thereof to an actuating mechanism fixed through a central aperture of the web. The actuating mechanism includes an actuator for moving the ribs between a closed and an open position. In use, the person manually actuates the actuator, causing the actuating mechanism to pivot each of the ribs from the closed position into the open position. When in the open position, the germ barrier may be used to grasp the surface through the web, preventing direct contact between the person and the surface.

The novel features which are considered characteristic of the present invention are set forth in the appended claims. The invention itself, however, both as to the construction and its method of operation, together with additional objects and advantages thereof, will be best understood from the following description of the specific embodiments when read and understood in connection with the accompanying drawing.

DETAILED DESCRIPTION OF THE PREFERRED EMBODIMENT

Figure 1:
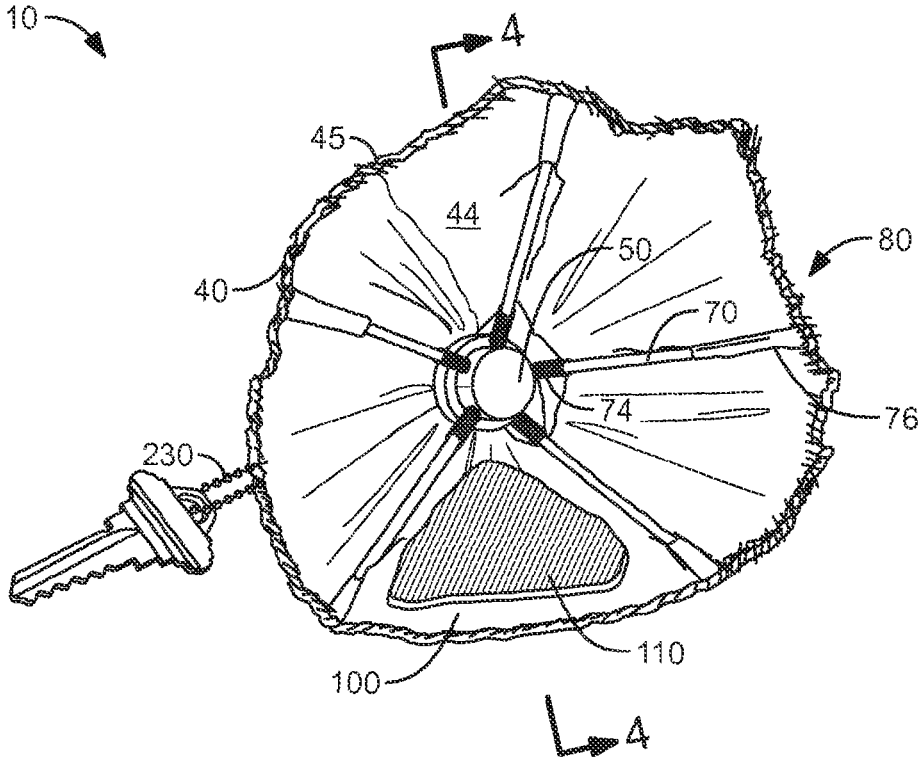
FIG. 1 is a perspective view of the invention, illustrated in an open position.
Figure 2:
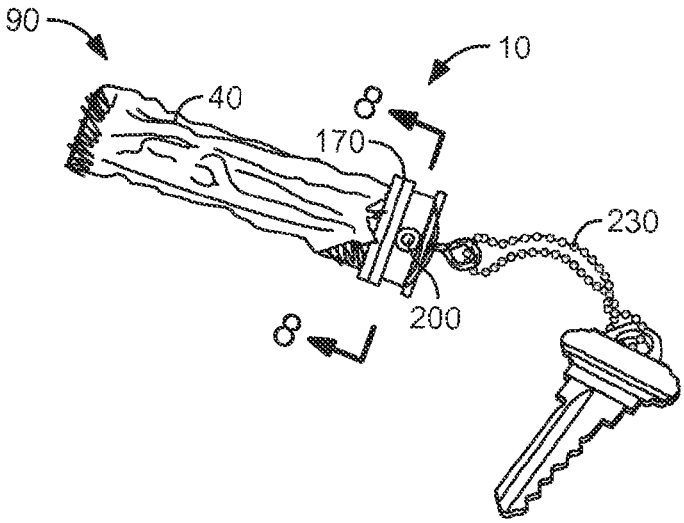
FIG. 2 is a perspective view of the invention, illustrated in a closed position.
Figure 6:
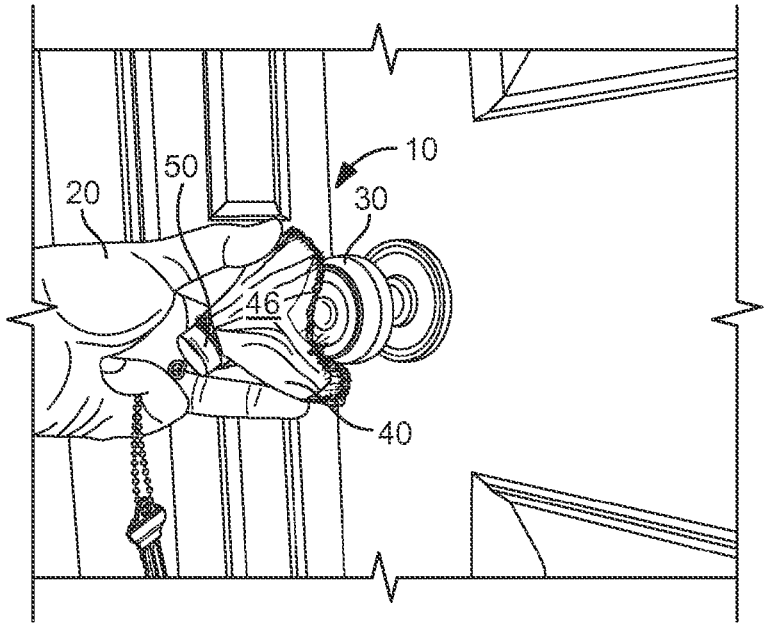
FIG. 6 is a perspective view of the invention in-use with an unsanitary surface on a doorknob.
Figure 7:
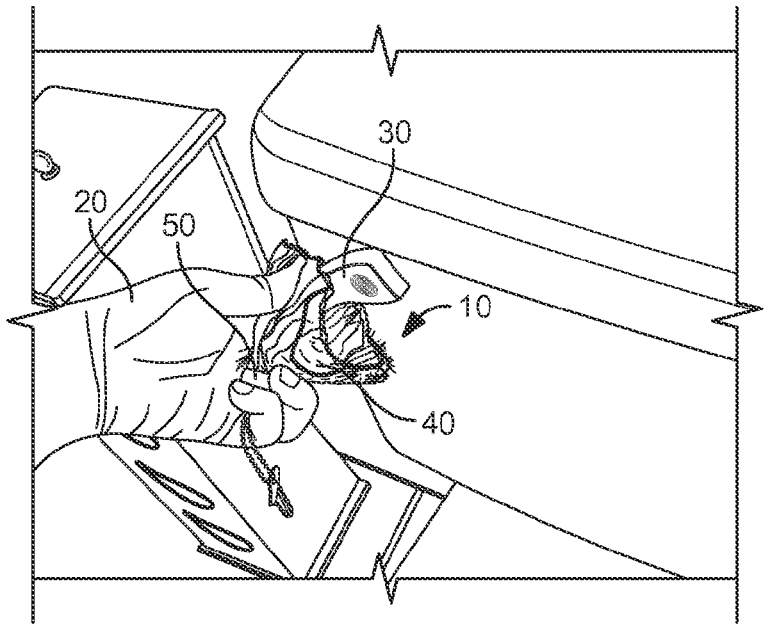
FIG. 7 is a perspective view of the invention in-use with an unsanitary surface on a toilet handle.

FIGS. 1 and 2 illustrate a germ barrier 10 for protecting a person 20 from direct contact with an unsanitary surface 30, such as a doorknob (FIG. 6), a toilet handle (FIG. 7) or the like. The germ barrier 10 is portable, compact, and easy to use.

The germ barrier 10 comprises a flexible web 40 having an inside surface 44, an outside surface 46, and a peripheral edge 45. The flexible web 40 may be formed from a nano-silver coated fabric 100 so that the inside surface 44 includes anti-microbial and anti-bacterial properties, or other anti-bacterial solution coated fabric, such as made by AEGIS Environments of Midland, Mich. (http://www.microbeshield.com). Alternately, the inside surface 44 may be coated with an anti-bacterial solution (not shown) known in the art. Additionally, the web 40 may be impregnated with anti-microbial and anti-bacterial agents (not shown). Further, the inside surface 44 and outside surface 46 may each further include at least one high-friction pad 110 fixed thereto, whereby each pad 110 may be made from rubber or some other suitable high-friction material. Each pad 110 may be bonded to the web 40, sewn, or attached with other suitable means (not shown). An actuating mechanism 50 is fixed through a central aperture 48 of the web 40. The actuating mechanism 50 includes an actuator 60 that is manually actuable from the outside surface 46 of the web 40. A keychain 230 or the like may be fixed to the actuating mechanism 50, as desired (FIG. 2).

Figure 4:
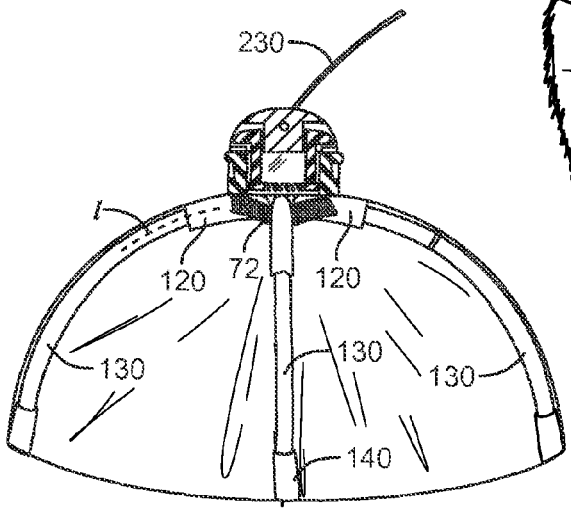
FIG. 4 is a cross-sectional view of the invention, taken generally along lines 4-4 of FIG. 1, illustrating an alternate embodiment of the actuating mechanism.
Figure 5:
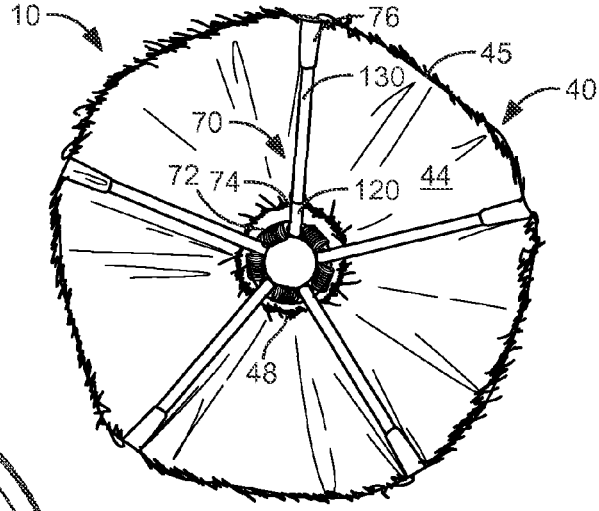
FIG. 5 is a bottom plan view of the invention, illustrated in the open position.

A plurality of stiffening ribs 70 are included, with each fixed to the web 40, preferably on the inside surface 44 thereof. Each rib 70 is pivotally fixed at a proximal end 74 to the actuating mechanism 50. Each rib 70 further includes a distal end 76 that terminates proximate the peripheral edge 45 of the web 40. Each stiffening rib 70 is preferably made from a resilient material such as plastic or the like. Alternately, each rib 70 may be made from a rigid material, such as metal, wood, or the like. In one embodiment of the invention, each rib 70 comprises a proximal portion 120 made from a rigid material and a distal portion 130 made from a resilient material, the proximal and distal portions 120, 130 being mutually fixed together along a common longitudinal axis l (FIGS. 4 and 5).

In use, the person 20 manually actuates the actuator 60, causing the actuating mechanism 50 to pivot each of the ribs 70 from a closed position 90 (FIGS. 2 and 8) into an open position 80 (FIGS. 1, 4, 5, and 9). When in the open position 80, the germ barrier 10 may be used to grasp the unsanitary surface 30 through the web 40, preventing direct contact between the person 20 and the unsanitary surface 30. The high-friction pads 110 facilitate gripping of the unsanitary surface 30 by the person 20.

Figure 8:
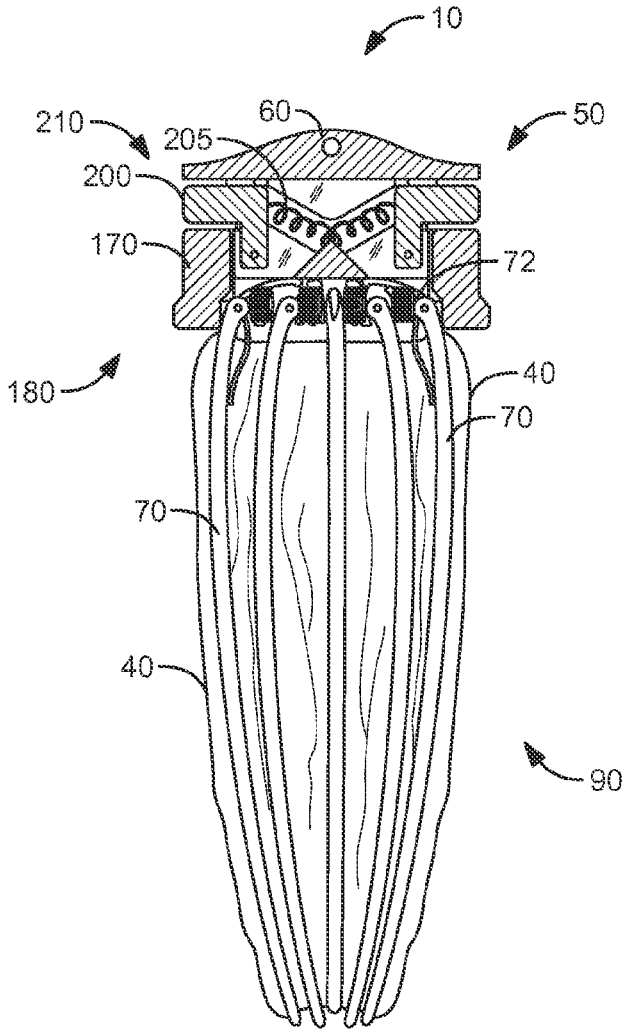
FIG. 8 is a cross-sectional view of the invention, taken generally along lines 8-8 of FIG. 2, illustrating a preferred embodiment of the actuating mechanism in the closed position.
Figure 9:
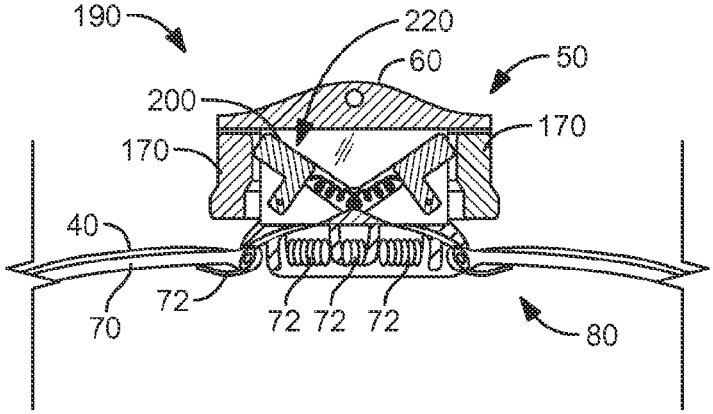
FIG. 9 is a cross-sectional view of the embodiment of FIG. 8, illustrating the actuating mechanism in the open position.

In one embodiment, the actuating mechanism 50 comprises the actuator 60 pivotally fixed to each rib 70, in which each rib 70 further including a torque spring 72 that urges the rib 70 into the open position 80. The actuator 60 further includes a locking collar 170 (FIGS. 2, 8, and 9) that, in a lowered position 180, forces each rib 70 into the closed position 90 (FIG. 8). In a raised position 190 the locking collar 170 allows the ribs 70 to be urged into the open position 80 by each torque spring 72 (FIG. 9).

The locking collar 170 may be moved from its lowered position 180 to its raised position 190 through a screw thread between its inside surface and the outside surface of the actuator 60 (not shown). Preferably, however, the locking collar 170 slides up and down on the actuator 60, and the actuator 60 includes at least one locking button 200 fixed within the actuator 60. A lock spring 205 urges each locking button 200 into a locked position 210 (FIG. 8) such that each locking button 200 prevents the collar 170 from attaining the raised position 190, thereby keeping the germ barrier 10 in the closed position 90. However, when each locking button 200 is depressed into an unlocked position 220 (FIG. 9), the locking collar 170 is free to slide up the actuator 60 to achieve its raised position 190, thereby freeing each rib 70 to pivot on the actuating mechanism 50 into the open position 80.

Figure 3:
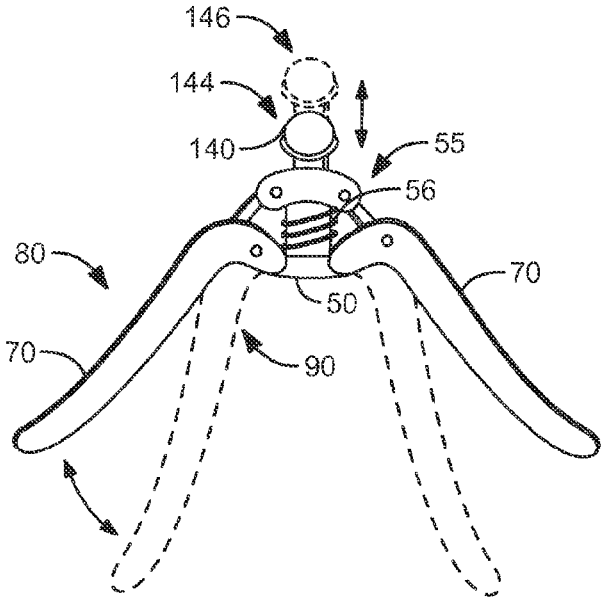
FIG. 3 is a side elevational view of one embodiment of an actuating mechanism of the invention.

In an alternate embodiment of the invention, illustrated in FIG. 3, the actuator 60 of the actuator mechanism 50 is a plunger 140 that moves from an open position 144 proximate the web 40 to a closed position 146 away from the web 40 through a triangular pivot arrangement 55. A spring 56 urges such an actuator mechanism 50 into the closed position 90. Clearly, other actuator mechanisms 50 could be utilized without departing from the spirit and scope of the invention, provided that whatever mechanism used allows the person 20 to easily move the germ barrier 10 back and forth between its closed position 90 to its open position 80.

In an alternate embodiment of the invention, illustrated in FIGS. 10-13, an actuator 240 is pivotally attached to the proximal end 74 of each of the stiffening ribs 70. Each rib 70 includes a torque spring 250 urging the rib 70 into the open position 80. The actuator 240 further includes a locking collar 260 that, in a lowered position 262 (FIG. 13) forces each rib 70 into the closed position 90. In a raised position 268, the locking collar 260 allows each rib 70 to be urged into the open position 90 by its torque spring 250. Such a torque spring 250 may be the tendency of a resilient plastic material from which each rib 70 is made, for example, to achieve its original molded shape. Each rib 70 may pivot about such a torque spring 250, a biased living hinge for example, between its open and closed positions 90, 80.

Figure 10:
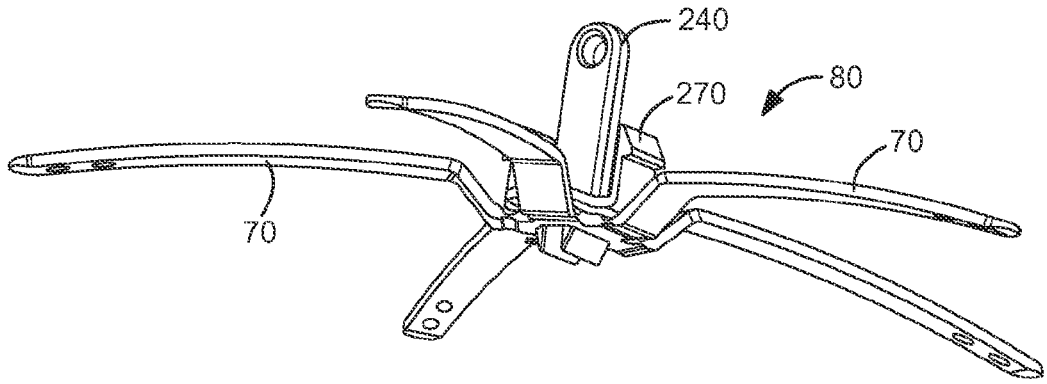
FIG. 10 is a partial perspective view of an alternate embodiment of the invention.
Figure 11:
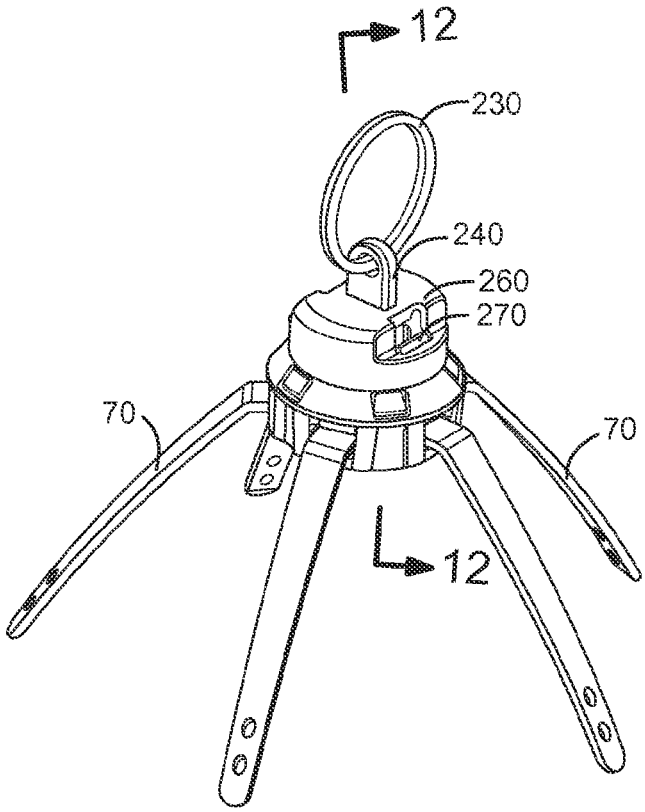
FIG. 11 is a perspective view of the alternate embodiment of FIG. 10, illustrated between the open and closed position.
Figure 12:
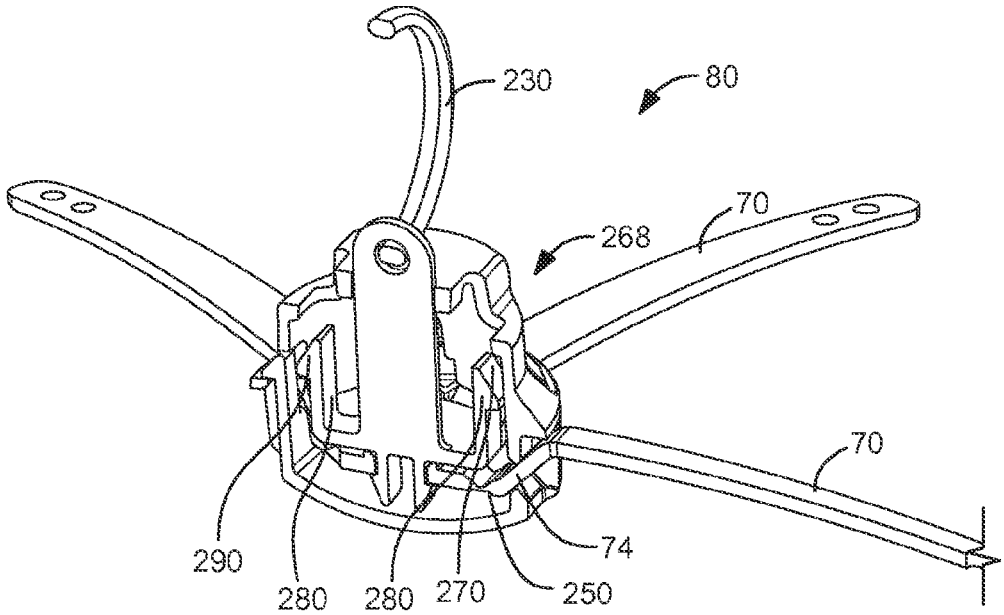
FIG. 12 is a cross-sectional view of the embodiment of FIG. 10, taken generally along lines 12-12 of FIG. 11, and illustrating ribs of the invention in the open position.
Figure 13:
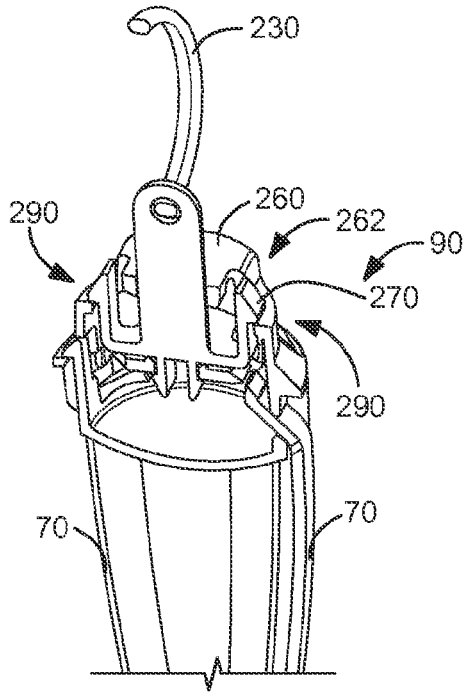
FIG. 13 is a cross-sectional view of the embodiment of FIG. 10, taken generally along lines 12-12 of FIG. 11, and illustrating the ribs in the closed position.

Preferably such an embodiment further includes at least one locking button 270 fixed with the actuator 240 (FIG. 12). A lock spring 280, such as a resilient portion of the locking button 270, urges each locking button 270 into a locked position 290 such that each locking button 270 prevents the locking collar 260 from attaining the raised position 268 (FIG. 13). When each locking button 270 is depressed, clearance is provided for the locking collar 260 to achieve its raised position 268 to open the germ barrier 10 (FIGS. 10 and 12).

While a particular form of the invention has been illustrated and described, it will be apparent that various modifications can be made without departing from the spirit and scope of the invention. For example, the flexible web 40 may be made from fabric, rubber, paper, plastic, or other suitably flexible web materials. Moreover, while the drawings illustrate particular embodiments, clearly the number of stiffening ribs 70 illustrated in the drawings may be changed without departing from the intent of the invention. Further, while the illustrations show the web 40 as a generally circular shape in plan view, the web 40 may also be made in an oval, rectangular, square, hexagon, octagon, pentagon, or any other suitable shape as desired. Accordingly, it is not intended that the invention be limited, except as by the appended claims.

What is claimed is:

1. A germ barrier for protecting a person from direct contact with an unsanitary surface, the germ barrier comprising:

a flexible web having an inside surface for engagement with the unsanitary surface, an outside surface, and a peripheral edge;

an actuating mechanism fixed through a central aperture of the web, the actuating mechanism including an actuator manually actuable from the outside surface of the web to move the web between a compact closed position and a spread open position; and a plurality of stiffening ribs each fixed to the inside surface of the flexible web and pivotally fixed at a proximal end to the actuating mechanism, each stiffening rib having a distal end that terminates proximate the peripheral edge of the web;

wherein actuating the actuator while grasping the actuating mechanism causes each stiffening rib to pivot outwardly, thereby separating the distal ends of the plurality of stiffening ribs and causing the web to assume the open position for engagement of the inside surface with the unsanitary surface; and wherein the inside surface further includes at least one high-friction pad fixed thereto to facilitate gripping the unsanitary surface.

2. The germ barrier of claim 1 wherein the flexible web is formed from a nano-silver coated fabric.

3. The germ barrier of claim 1 wherein the outside surface further includes at least one high-friction pad fixed thereto.

4. The germ barrier of claim 1 wherein each stiffening rib is made from a resilient material.

5. The germ barrier of claim 1 wherein each stiffening rib is made from a rigid material.

6. The germ barrier of claim 1 wherein a proximal portion of each rib is made from a rigid material and a distal portion of each rib is made from a resilient material, the proximal and distal portions mutually fixed together along a common longitudinal axis.

7. The germ barrier of claim 1 wherein the actuator moves from an open position proximate the web to a closed position away from the web.

8. The germ barrier of claim 1 wherein the actuator is pivotally attached to the proximal end of each of the stiffening ribs, each rib including a torque spring urging the rib into the open position, the actuator further including a locking collar that, in a lowered position forces each rib into the closed position, and in a raised position allows each rib to be urged into the open position by the torque spring.

9. The germ barrier of claim 8 further including at least one locking button fixed within the actuator, a lock spring urging each locking button into a locked position wherein the locking button prevents the collar from attaining the raised position, whereby each locking button keeps the germ barrier in the closed position and, when depressed, provided clearance for the locking collar to achieve its raised position to open the germ barrier.

* * * * *